US005212336A

United States Patent [19]

Barcus

[11] Patent Number: 5,212,336

[45] Date of Patent: May 18, 1993

[54] PLANAR WAVE TRANSDUCER ASSEMBLY

[75] Inventor: Lester M. Barcus, Huntington Beach, Calif.

[73] Assignee: Barcus-Berry, Inc., Hungtington Beach, Calif.

[21] Appl. No.: 720,406

[22] Filed: Jun. 25, 1991

[51] Int. Cl.[5] ..... G10H 1/00; G10H 3/00

[52] U.S. Cl. ..... 84/730; 84/192; 84/723; 84/DIG. 24

[58] Field of Search ..... 84/723, 730, 731, 742, 84/743, 744, DIG. 24, 192, 193

[56] References Cited

U.S. PATENT DOCUMENTS

| | | | |
|---|---|---|---|
| 4,058,045 | 11/1977 | Jennings et al. | 84/DIG. 24 |
| 4,230,013 | 10/1980 | Wellings | 84/743 |
| 4,378,721 | 4/1983 | Kaneko et al. | 84/DIG. 24 |
| 4,567,805 | 2/1986 | Clevinger | 84/DIG. 24 |
| 5,078,041 | 1/1992 | Schmued | 84/731 |

OTHER PUBLICATIONS

Retailer, vol. 9, No. 2, Feb. 24, 1992, "Electrifying Acoustic Pianos".

*Primary Examiner*—William M. Shoop, Jr.
*Assistant Examiner*—H. Kim
*Attorney, Agent, or Firm*—Hawes & Fischer

[57] ABSTRACT

A planar wave transducer assembly comprising a rigid structure formed by a pair of foot pads, each with an upstanding leg and a span bar extending across the top of the legs. A piezoelectric transducer element is attached to the span bar, preferably in a channel extending between the legs, to convert wave motion in the plane defined by the flat bases of the foot pads into an electrical signal. The transducer assembly herein disclosed has been found to be remarkably effective as a pick up when applied to the soundboard of a piano, achieving excellent signal isolation as well as enhancing the acoustic sound produced by the instrument.

13 Claims, 3 Drawing Sheets

PLANAR WAVE TRANSDUCER ASSEMBLY

BACKGROUND OF THE INVENTION

1. Field of the Invention

The present invention relates to a planar wave transducer assembly that is useful for translating the planar waves of a musical instrument into an electric signal.

2. Background Art

The sounds produced by musical instruments today are often converted into electrical signals for amplification and other processing. Certain musical instruments, such as a piano, incorporate a large soundboard that not only translates the vibrations of strings into corresponding air vibrations, but also tends to pick up vibrations transmitted from the amplified sound of the piano and from other audio sources through the air to the soundboard. In view of the foregoing, when a piano is being used with sound reinforcement or in a high sound level environment, it is virtually impossible to obtain substantial feedback rejection or good isolation of the piano sounds from those of other musical instruments or sound sources in the same environment.

Furthermore, because the type of motion which translates string vibration into corresponding air vibrations exhibits distinct patterns of active and null zones distributed over the entire area of the soundboard, and because these patterns are different for each note or combination of notes played on the instrument, it is virtually impossible to define any single location on the soundboard where placement of a vibration sensor would enable the sensor to provide a properly-balanced representation of every tone produced by the keyboard.

Accordingly, a major object of the present invention is to achieve a transducer assembly that will produce an electrical signal that accurately represents the piano's complex tones. Another object is to achieve such a transducer assembly that isolates the piano's tones from non-piano sounds in the same environment. Another object is to achieve such a transducer assembly that provides substantial feedback rejection when high-level sound reinforcement techniques are employed. A further object is to achieve such a transducer assembly which enhances the piano's tones. Still another object is to achieve such a transducer assembly which can provide an accurate and well-balanced representation of the acoustic sound when positioned at virtually any location on the soundboard. These and further objects will appear to those skilled in this field from the following description of a preferred embodiment of the transducer assembly of the present invention.

BRIEF SUMMARY OF THE INVENTION

The planar wave transducer assembly of the present invention employs a rigid structure that includes a plurality of foot pads, each foot pad having attached to it an upstanding leg, and a span bar attached to the tops of the legs above the foot pads such that lateral or longitudinal movement of the foot pads relative to one another is transferred to the legs and then to the span bar. A piezoelectric transducer element is attached to the span bar to convert the mechanical force applied to the span bar, as a result of such lateral or longitudinal movement of the foot pads relative to one another, into an electrical signal. This signal may be applied to an electronic system for sound reinforcement, recording or other applications.

Preferably the transducer assembly is a simple bridge structure. The foot pads are separated by a distance of about an inch, and the span bar is relatively narrow to readily respond to and transmit relative lateral movement of the foot pads to the piezoelectric transducer element. Preferably the transducer element is embedded in a channel between the legs.

For use with a musical instrument such as a piano, the foot pads preferably are attached to the soundboard. As a result, planar waves transmitted along the surface of the soundboard will result in production of an electrical signal by the transducer assembly. However, vibrations in the vertical mode will not produce any significant electrical response from the transducer assembly.

BRIEF DESCRIPTION OF THE DRAWINGS

The invention will be further described in connection with the accompanying drawings in which.

FIG.. 1 is a perspective view of a preferred transducer assembly of the present invention mounted on a soundboard.

DETAILED DESCRIPTION

It has long been known that soundboards such as those incorporated in a piano and similar musical instruments vibrate in a direction perpendicular to the plane they define. These vibrations have been the subject of recent studies such as reported in the *Galpin Society Journal* by Edward L. Kottick, "The Acoustics of the Harpsichord: Response Curves and Modes of Vibrations," Volume 37, pages 55–75 (1985). They are also reported in "Acoustical Analysis of a Harpsichord" by Savage et al., *Journal of the Acoustical Society of America* (in print).

To accurately represent electrically the vibrations of a musical instrument soundboard, the classic approach has been to use a contact sensor. Thus, various transducers have been designed to sense the vibrations of the soundboard in a direction perpendicular to the plane it defines. However, it is exceedingly difficult, if not impossible, to isolate the piano's complex tonal structure from extraneous sounds transmitted to the soundboard by other sources when sensing such perpendicular vibrations.

The present invention follows a different approach. It is based on the realization that string energy transmitted to a soundboard by the mechanism of, for example, a musical instrument such as a piano, results in transverse energy waves in the soundboard, which travel at high speed in the plane defined by the soundboard. These waves tend to compress and expand portions of the soundboard slightly. It has been found that these transverse energy waves can be sensed, such as by using a transducer assembly of the design described in this specification and that the resulting electrical representation of such planar waves is a highly accurate representation of the piano's complex tones. In other words, such planar waves are essentially isolated from vibrations imparted to the soundboard from other sources, and they appear to incorporate only the energy imparted to the soundboard by the musical structure of which it is a part. Thus, by using a transducer assembly designed to sense only such planar waves it is possible to achieve outstanding feedback rejection at high sound reinforcement levels as well as excellent isolation of the piano's sounds from non-piano sounds.

Figure 1:
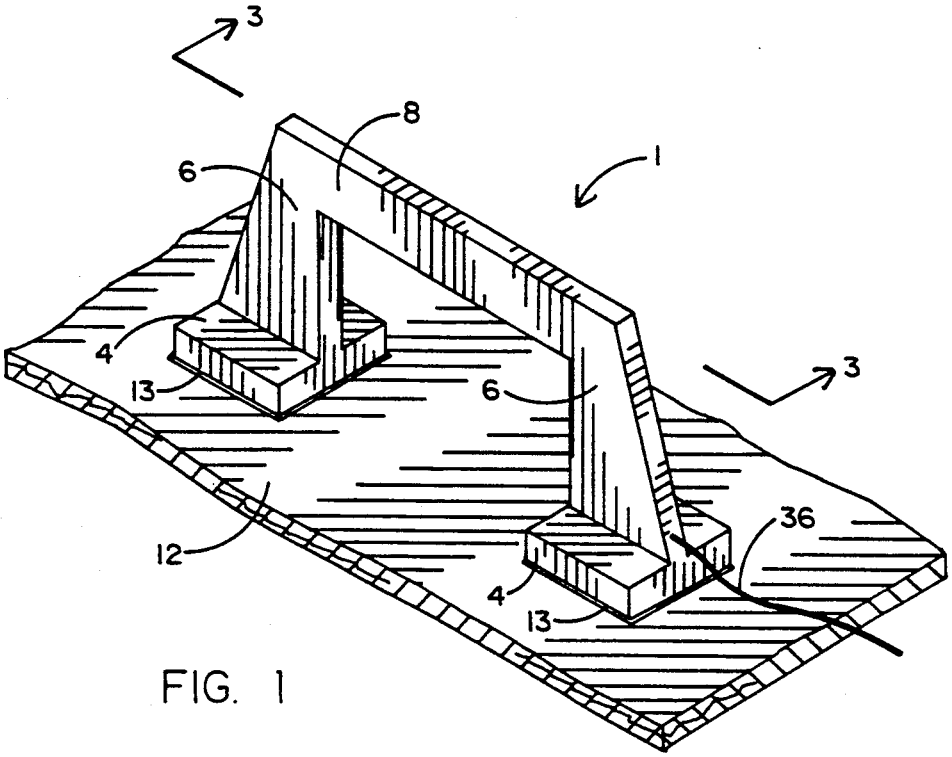

Shown in FIG. 1 is a presently preferred form of such a planar wave transducer assembly 1. Assembly 1 consists of two foot pads 4, each of which has an upstanding leg 6, the legs being connected to one another by a span bar 8. Preferably, the structure of the transducer assembly 1 is cast or formed as a unitary element out of aluminum. Also, each leg 6 preferably slopes from a relatively wide base at the foot pad 4 to a relatively narrow shoulder at the span bar 8. Such a shaping, resulting in a tapered leg 6, appears to minimize or eliminate any spurious resonant frequencies in the structure.

Figure 2:
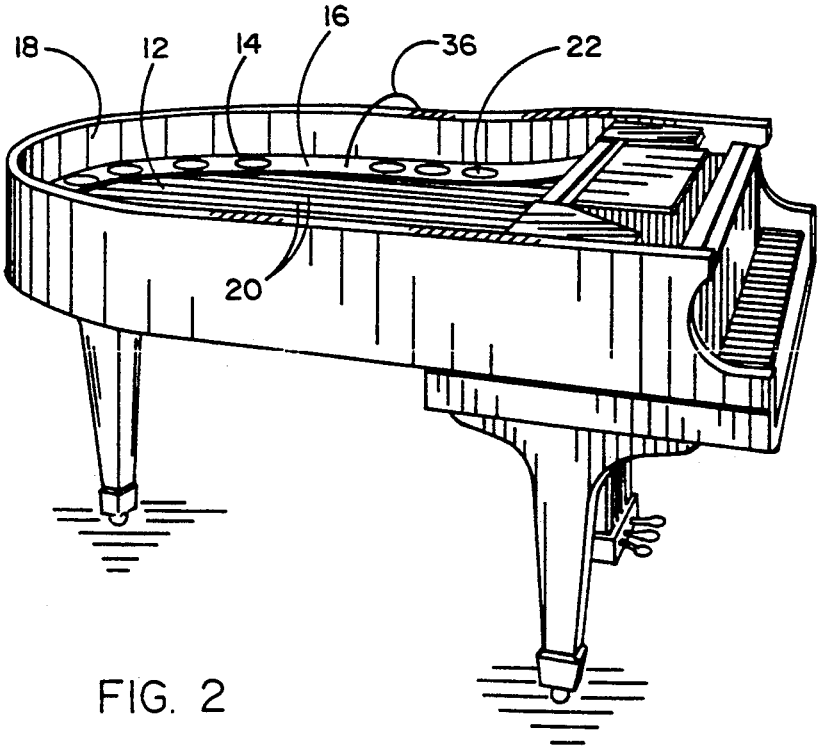
FIG. 2 is a perspective view of a piano showing the transducer assembly mounted thereon.

Preferably the foot pads 4 of the transducer assembly 1 are bonded to a soundboard 12 by a transfer adhesive 13. A suitable adhesive is 3M's "Scotch" brand Hi Performance Adhesive #468. When used as a piano transducer, the transducer assembly 1, as shown in FIG. 2, may be conveniently attached to the soundboard 12 via one of the openings 14 in the metallic frame or harp 16 within the case 18 of the piano 19, the piano strings 20 being strung between the tuning pins in the pin block and hitch pins in the metal frame 16. Strings 20 pass over a bridge 22 that transmits energy to the underlying soundboard 12 and results in both planar waves and perpendicular vibrations in the soundboard.

Figure 3:
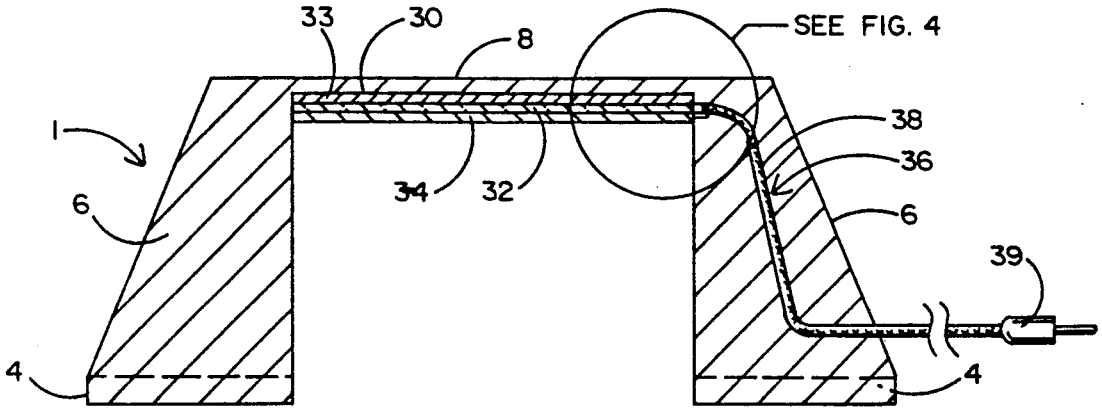
FIG. 3 is a vertical, sectional view of the transducer assembly taken on lines 3—3 of FIG. 1.
Figure 4:
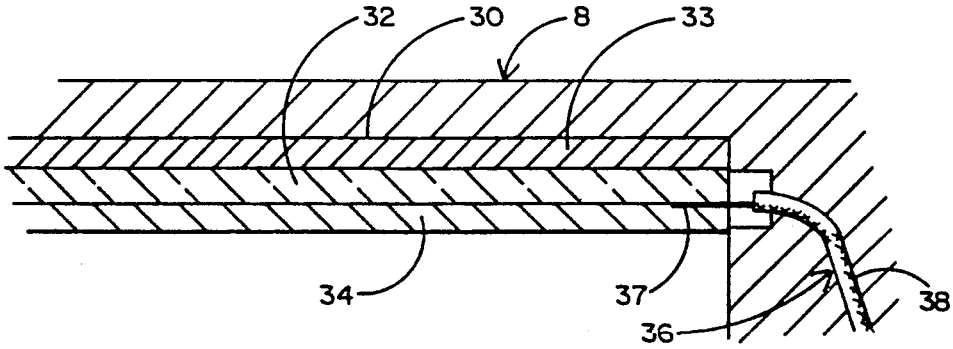
FIG. 4 is an enlarged detail of the transducer assembly taken from FIG. 3.

Referring concurrently to FIGS. 1–4 (and as is best shown in FIG. 3), the presently preferred form of transducer assembly 1 incorporates or has formed in the underside of span bar 8 a channel 30. Channel 30 receives a transducer element 32, which is preferably a piezoelectric bar. Transducer element 32 may be conveniently attached or bonded in the channel 30 by a silver conductive epoxy 33 and then covered by an insulating epoxy 34 (best shown in FIG. 4).

Figure 5:
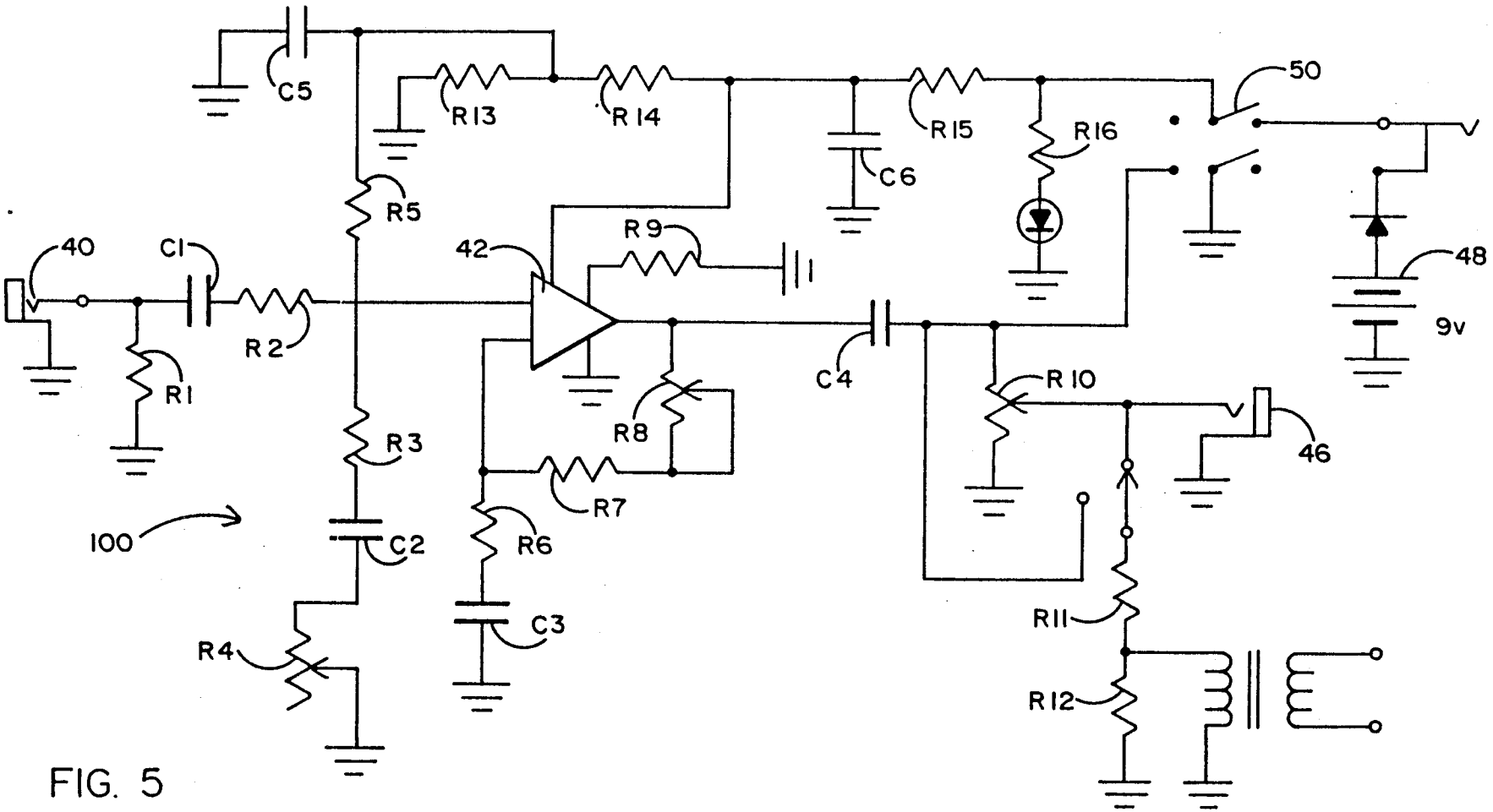
FIG. 5 is an electrical schematic diagram of a suitable preamplifier which may be employed in connection with the transducer assembly.

Attached to piezoelectric transducer element 32 is a fine coaxial cable 36, the center lead 37 of which being attached to the face of transducer element 32 on the side directed toward the soundboard. The outer sheath 38 of cable 36 is attached to the conductive metallic structure that defines the foot pads 4, legs 6 and span bar 8, and, through this structure and the conductive attachment 33, to the opposite side of the transducer element 32. As a result, any movement of the soundboard 12 which tends to move one foot pad 4 relative to the other in a direction in the plane of the soundboard will result in stresses being applied to the bridge structure 22 and to the transducer element 32. This in turn results in an electrical signal in cable 36. Means, such as a connector 39, are provided to apply the signal in cable 36 to an electronic system (as shown in FIG. 5).

As previously stated, it has been found that planar waves on a piano soundboard accurately represent or depict the sound produced by the soundboard. Such planar waves on soundboard 12 tend to move the foot pads 4 toward or away from each other, or laterally relative to one another. However, the vibrations produced in the soundboard 12, which tend to cause the soundboard to flex up and down and produce the sounds that are transmitted through the air to listeners, tend to move the foot pads 4 up and down with one another and do not appear to provide significant or appreciable mechanical forces to transducer element 32 or electric signals in cable 36.

In a presently preferred construction, the bridge structure 22 is made of aluminum. Each foot pad 4 of the transducer assembly 1 is approximately $\frac{5}{8}$ square. The legs 6 and the span bar 8 are each approximately 2/10 of an inch thick. The pads 4 may be 1/16 to $\frac{1}{8}$ of an inch thick. The top surface of the span bar 8 may be approximately 1" above the bottom surface of the foot pads, and the span bar 8 approximately $\frac{1}{8}$ of an inch deep. The far edges of the foot pad 4 may be approximately $2\frac{1}{2}$ inches apart, and the near edges of the foot pad 4 approximately $1\frac{1}{4}$ inches apart, the taper resulting in a top surface of span bar 8 which is approximately $1\frac{3}{4}$ inches long. The channel 30 formed in the underside of the span bar 8 may be approximately 0.156" wide to leave a wall on either side thereof approximately 0.020" thick. The piezoelectric element 32 may be a lead-zirconium-titanate microcrystalline material, which is a ceramic that is polarized after being fabricated. It should be shaped and sized to be loosely received within the channel 30 in the span bar 8 between legs 6.

The signal produced in cable 36 by piezoelectric transducer element 32 may be applied to any convenient or suitable preamplifier. One such preamplifier 100 is shown in FIG. 5. Preamplifier 100 consists of an input socket 40 for connector 39 (of FIG. 3) which applies the signal on cable 36 through an RC network to an amplifier 42. The output of the amplifier 42 may be applied through a variable resistor R10 to an output jack 46. A source of power (e.g. a battery) 48 is applied through a switch 50 and various passive components to the amplifier 42.

In FIG. 5, the various components of preamplifier 100 are shown by conventional symbols. Their values may be as follows:

R1 2 MegaOhms
C1 0.05 Microfarads
R2 200 KiloOhms
R3 2 KiloOhms
C2 0.003 Microfarads
R4 50 KiloOhms (adjustable)
R5 2 MegaOhms
R6 220 KiloOhms
C3 10 Microfarads
R7 30 KiloOhms
R8 1 MegaOhms (adjustable)
R9 320 KiloOhms
C4 47 Microfarads
R10 10 KiloOhms (adjustable)
R11 5.6 KiloOhms
R12 2 KiloOhms
C5 100 Microfarads
R13 5 KiloOhms
R14 5 KiloOhms
C6 100 Microfarads
R15 200 KiloOhms
R16 2 KiloOhms The battery 48 is a 9 V battery. Amplifier 42 preferably is an IC4250 element.

Such a preamplifier 100, as illustrated and described, may be located at or near the piano, or otherwise close to the transducer assembly 1. Preamplifier 100 provides impedance matching between the transducer assembly 1 and any signal processing or recording electronic system. However, any of various amplifiers or electronic systems can be employed with planar wave transducer assembly 1 of this invention. For example, the electronic signal on cable 36 could be applied directly to a conventional guitar amplifier or to the electronic feed for a recording studio console, if desired.

The planar wave transducer assembly 1 herein disclosed may be used on many instruments other than a piano, including a harp or harpsichord to give but two examples. Assembly 1 can also be employed in a number of other, non-musical applications, e.g. the measurement of physical properties of materials.

When employed in a piano of conventional construction, the output of transducer assembly 1 can make the instrument sound like the finest of pianos. The top-end notes tend to ring like bells, while the low-end notes exhibit a richness and depth of tone characteristic like that from fine pianos of the largest dimensions. All in all, by detecting planar waves in soundboards, the result is a significant enhancement in the quality and character of the musical instrument. The instrument also becomes more responsive since the electrical signal produced by the transducer assembly 1 does not exhibit the time delay which is characteristic of tone production in all acoustic musical instruments.

These characteristics are achieved while obtaining maximum isolation between the sounds produced by the musical instrument itself and sounds occurring in the surrounding environment. There is also no significant feedback at extremely high sound reinforcement levels, even with the piano lid in a raised to an open position.

The signal in coaxial cable 36 can also be applied effectively to digital delays, chorus effects and other signal processing devices.

While a presently preferred embodiment of the planar wave transducer assembly 1 has been described, variations in its construction will be apparent to those skilled in this field. For this reason, the scope of the invention should not be limited to the disclosed embodiment, but rather is set forth in the following claims.

I claim:

1. For a musical instrument having a soundboard, a transducer assembly to convert into an electrical signal the wave motion produced in the soundboard during the playing of said instrument, said transducer assembly comprising:

first and second legs, means for bonding said first and second legs to the soundboard in a spaced relationship to one another, such that one of said legs moves on the soundboard relative to the other leg in response to the wave motion produced in said soundboard, means for sensing the movement of said one leg relative to the other leg, and means for converting the sensed movement into an electrical signal.

2. The transducer assembly as set forth in claim 1 in which said first and second legs are part of a relatively rigid, unitary structure, said sensing means comprising a piezoelectric element, said transducer assembly further comprising means for attaching the piezoelectric element to the rigid structure to sense planar wave motion transmitted through said structure corresponding to the movement of said one leg relative to the other leg.

3. The transducer assembly as set forth in claim 2 in which the rigid structure is tapered between said first and second legs and said sensing means to minimize distortion of the planar wave motion transmitted through said structure.

4. A planar wave transducer assembly connected to a planar surface and including:

a pair of foot pads connected in spaced relationship with one another to the planar surface, such that one of said foot pads moves along said planar surface relative to the other foot pad in response to wave motion produced in said planar surface, an upstanding leg integral with each foot pad, a span bar integral with the legs above the foot pads, the span bar, legs and foot pads being integral parts of a relatively rigid unitary structure such that the movement of said one foot pad relative to said other foot pad is transmitted through the legs to the span bar, an electrical transducer element for converting mechanical force into an electrical signal, means attaching the electrical transducer element to the span bar to sense said movement of said one foot pad along said planar surface and to convert such movement to an electrical signal, and means to electrically connect the transducer element to an electronic system.

5. The planar wave transducer assembly as set forth in claim 4 in which each of the upstanding legs is tapered to minimize spurious frequencies in the rigid structure formed thereby.

6. The planar wave transducer assembly as set forth in claim 4 in which the span bar includes a channel extending between the legs, said transducer element being bonded within the channel and attached to the span bar.

7. The planar wave transducer assembly as set forth in claim 6 in which the foot pads, legs and span bar form a unitary electrically conductive metallic structure.

8. The planar wave transducer assembly as set forth in claim 7 in which the electrical transducer element is a piezoelectric element having first and opposite faces, the first face of the element being affixed by a conductive bond to the channel of said span bar, the opposite face of the transducer element being electrically insulated from the conductive rigid structure, and said transducer assembly further including a coaxial cable, the outer sheath of which is connected to the conductive rigid structure, the center conductor of which is electrically connected to the insulated opposite face of the transducer.

9. The planar wave transducer assembly as set forth in claim 4 wherein each of said upstanding legs has a first end and an opposite end, the first ends of said legs connected to respective foot pads and the opposite ends of said legs connected to said span bar, such that said span bar extends between said legs at the farthest distance therealong from said foot pads.

10. The planar wave transducer assembly as set forth in claim 4 including means to attach said pair of foot pads to the planar surface so that said transducer element produces said electrical signal in response to planar waves that propagate along the surface of the planar surface, said transducer element being substantially non-responsive to vibrations that propagate at a right angle to the planar surface and in transverse alignment to said planar waves.

11. The planar wave transducer assembly as set forth in claim 4 wherein said planar surface is a soundboard of a musical instrument.

12. For a vibratile body having a surface that receives vibrations which propagate at the right angle to the surface of said body for producing sound pressure waves in the air and planar waves that generate the vibrations and propagate along the surface of said body in transverse alignment with said vibrations but do not produce pressure waves in the air, a transducer assembly for converting the planar waves into an electrical signal and comprising:

means connected to said vibratile body and responsive to the planar waves received by the vibratile body and substantially non-responsive to the vibrations which produce sound pressure waves in the air; and means connected to said responsive means for converting the planar waves into an electrical signal that is representative of said planar waves propagating along the surface of said body.

13. The transducer assembly recited in claim 12, wherein said means responsive to the planar waves includes first and second legs bonded to the surface of said body in spaced relationship with one another, such that one of said legs moves along said surface relative to the other leg in response to said planar waves; and said means for converting the planar waves into an electrical signal including a transducer for sensing the movement of said one leg relative to the other leg.

* * * * *